United States Patent [19]

Gitlitz et al.

[11] Patent Number: 4,784,265

[45] Date of Patent: Nov. 15, 1988

[54] METHOD AND APPARATUS FOR PACKAGING AN OBJECT

[75] Inventors: Lawrence D. Gitlitz, W. Newton; John A. Volo, Mansfield, both of Mass.

[73] Assignee: New England Pottery Co., Inc., Foxborough, Mass.

[21] Appl. No.: 57,331

[22] Filed: May 28, 1987

[51] Int. Cl.[4] ..... B65D 85/44

[52] U.S. Cl. ..... 206/423; 53/399; 53/413; 53/449; 229/52 A; 229/52 AL

[58] Field of Search ..... 53/399, 413, 449; 229/52 A, 52 AC, 52 AL; 294/138, 149, 151, 155, 156; 493/88, 909; 206/423

[56] References Cited

U.S. PATENT DOCUMENTS

| | | | |
|---|---|---|---|
| 150,627 | 5/1874 | Stevens | 229/52 AC |
| 562,021 | 6/1896 | Phelan | 294/155 |
| 823,258 | 6/1906 | Burton | 294/155 X |
| 1,069,898 | 8/1913 | Nosek | 294/155 |
| 1,460,057 | 6/1923 | Eisen | 229/52 AC |
| 2,901,160 | 8/1959 | Vineberg | 229/52 A |
| 3,107,841 | 10/1963 | Fink | 229/52 A |
| 3,253,379 | 5/1966 | Foradora | 53/399 X |
| 4,684,163 | 8/1987 | Anderson | 294/149 |

FOREIGN PATENT DOCUMENTS

| | | | |
|---|---|---|---|
| 469437 | 11/1950 | Canada . | |
| 47342 | 12/1935 | France | 229/52 A |
| 108885 | 10/1943 | Sweden | 229/52 A |

*Primary Examiner*—John Sipos

*Attorney, Agent, or Firm*—Wolf, Greenfield & Sacks

[57] ABSTRACT

A method and apparatus for packaging an object, and in particular a fragile object such as an earthenware flower pot, which utilizes first and second bands of flexible material encircling the object in substantially perpendicular, vertical planes. The first band lies under the second band in the areas where the bands cross and has an opening formed in the top portion thereof on either side of the overlying second band. A handle is provided which spans the portion of the second band between the openings and has enlarged ends each of which passes through and engages one of the openings in the first band. The bands are preferably identical and interchangeable, are preferably formed of an impact resistant material to protect fragile objects, and may be provided in a plurality of different sizes, the bands selected to package a particular object being the smallest sized bands which will encircle such object.

12 Claims, 1 Drawing Sheet

METHOD AND APPARATUS FOR PACKAGING AN OBJECT

This invention relates to a method and apparatus for packaging an object and more particularly to a method and apparatus for packaging fragile containers such as earthenware flower pots.

BACKGROUND OF THE INVENTION

Over the years, many efforts have been made to develop suitable packaging devices for bulky, relatively heavy and frequently fragile objects such as earthenware flower pots. Various types of boxes or cartons, particularly corrugated boxes or cartons, offer some degree of protection for the object when it is being shipped to a retail establishment and when being carried by the ultimate purchaser, but do not permit the object to be easily viewed at the retail establishment, are bulky and cumbersome to package and carry and use a relatively large amount of packaging material, resulting in the packaging device being relatively heavy and bulky to ship and store. Bags offer little protection for the object and are therefore not normally suited for shipment of the object from the place of manufacture to the place of retail distribution. They also offer little protection for the object when taken home by the ultimate purchaser. Other available packaging devices suffer from one or more of the various deficiencies described above.

A need therefore exists for a packaging device and for a method of packaging bulky, relatively heavy, fragile objects. The packaging device should use a minimum of material to minimize material, shipping and storage costs while still providing substantial protection for the object when shipped or carried. The device should also permit the object to be easily viewed in a retail establishment, provide adequate space for printing required material, should be easily stackable and should be easily carried by the ultimate purchaser with minimum additional weight and bulk. Finally, the packaging device and the method for the utilization thereof should be simple and inexpensive so that it may be installed at the factory where the object is manufactured for shipment to retail establishments or may be utilized by the retailer to package objects for customers.

SUMMARY OF THE INVENTION

The foregoing and other objects, features, and advantages are provided by the device and method of this invention. In particular, this invention provides a packaging device for an object having a predetermined shape which utilizes first and second bands of flexible material which encircle the object in substantially perpendicular, vertical planes. A means is provided to maintain the relative position of the bands in at least a selected area and a means is provided to facilitate the carrying of the packaged object.

For preferred embodiments the first band lies under the second band in the areas where the bands cross and has an opening formed in the top portion thereof on either side of the overlying second band. A handle is provided which spans the portion of the second band between the openings and has enlarged ends each of which passes through and engages one of the openings in the first band. The bands are preferably substantially identical and interchangeable. For a preferred embodiment, each of the bands has a pair of notches formed one on each of the opposite edges of the band at substantially the center of the top portion thereof. Each of the bands also has the openings formed therein which openings are spaced substantially equally distant from the edges of the top portion of the band and are spaced from the center of such top portion by a distance substantially equal to one half of the width of the band. Each notch in the second band overlies a corresponding opening in the first band when the bands are properly positioned encircling the object and the ends of the handle pass through both the notch and the opening to maintain the desired relative position between the bands. Where the object is a fragile object, the bands are formed of impact resistant material such as corrugated cardboard. The bands may be provided in a plurality of sizes, the bands selected to package a particular object being the smallest sized bands which will encircle such object.

The foregoing and other objects, features, and advantages of the invention will be apparent from the following more particular description of a preferred embodiment of the invention as illustrated in the accompanying drawings.

THE DRAWINGS

DETAILED DESCRIPTION

Figure 1:
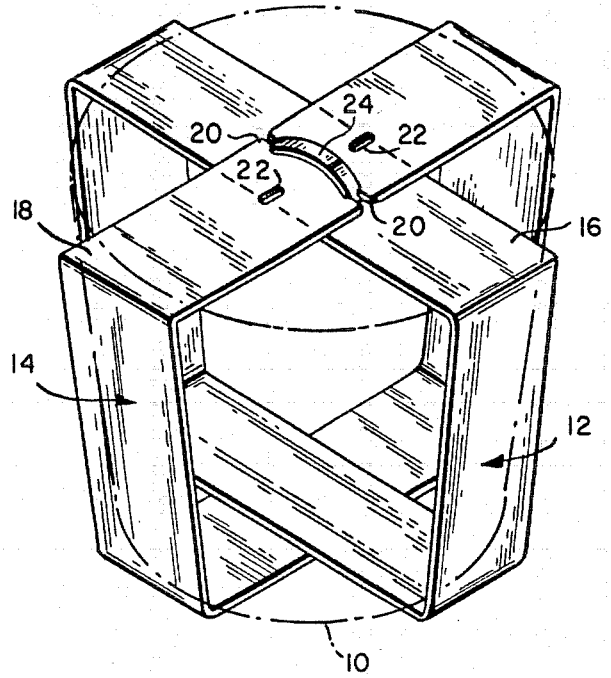
FIG. 1 is a perspective view of an assembled packaging device of this invention used to package a fragile flower pot.

Referring to the drawings, it is seen that an object 10, such as an earthenware flower pot, is packaged by being encircled with a first band 12 and a second band 14. The bands 12 and 14 are preferably identical and interchangeable and are formed of a material which is flexible to permit the bands to adapt to slight variations in the shape of object 10 and to be collapsed for storage, and are sufficiently strong to support the weight of the object. Where fragile objects are packaged, the material should also be impact resistant. For a preferred embodiment of the invention, the bands 12 and 14 are formed of corrugated cardboard. However, other materials such as foam plastic might be utilized.

The bands should be as narrow as possible to minimize material usage and maximize viewability of the object in the package while still affording sufficient material strength to support the weight of the object, and sufficient material to protect the object and keep it from falling out of the packaging device through one of the openings between bands. The bands should also be wide enough to afford adequate space to print desired information including product name and trademark, instructions, warranty, promotional material, UPC code, etc. For example, corrugated cardboard bands six inches wide have been found suitable for packaging a fourteen inch diameter earthenware flower pot.

Each band has a top portion or panel, 16 and 18 respectively, which portion overlies the object 10 when the packing device is assembled. A pair of notches 20 are formed, one on each edge of each of the top portions 16 and 18, at a point substantially at the center of each such portion. Each portion 16 and 18 also has two oval shaped openings 22 formed therein which openings are substantially equal distant from the edges of the portion and are spaced from the center of the portion by a distance substantially equal to one half the width of the band. Thus, when the bands are assembled, as shown in FIG. 1, the notches in portion 18 align with the openings 22 in portion 16.

Figure 2:
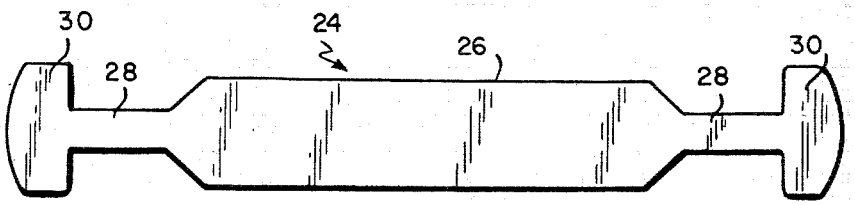
FIG. 2 is a top view of a handle suitable for use in the embodiment of the invention shown in FIG. 1.

The final element of the packaging device is a handle 24 which, as may be best seen in FIG. 2, has a center portion 26 which may be flat, rounded, or flat with rounded edges, a narrow neck 28 on either side of portion 24 and enlarged, generally barb-shaped portions 30 at both ends.

Figure 3:
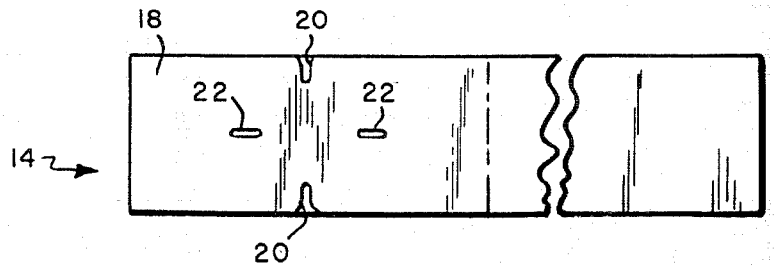
FIG. 3 is top view of a band suitable for use in the embodiment of FIG. 1 shown collapsed for storage or shipment.

For storage and shipment, the bands are collapsed as shown in FIG. 3 with the top portion and one side portion lying flat on top of the bottom portion and other side portion.

To assemble the device, the band 12 is fitted over object 10 and encircles the object in a first vertical plane. Band 14 is then fitted over the object and over band 12 to encircle the object in a second vertical plane which is substantially perpendicular to the vertical plane of band 12. The bands are aligned so that notches 20 in top portion 18 of band 14 overlie openings 22 in top portion 16 of band 12. The enlarged portions or barbs 30 of handle 24 are then fitted through the aligned notch 20 and opening 22 on each side of portion 18 and are turned to engage under openings 22. When handle 24 is mounted, its center portion 26 overlies the center of portion 18 and may be used to grasp and carry the object. Throat portions 28 resting in notches 20 and openings 22 lock the two bands together in the desired position. Bands 12 and 14 may be provided in a plurality of different sizes for use with different sized objects 10, the bands being selected for use with a particular object being the smallest sized bands which will encircle the object. While preferable the object has the same cross section in the vertical planes of both bands, and the bands are therefore of the same size, it is possible to package an object of irregular shape using bands of different size.

A packaging device and method has thus been provided which permits easy viewing of the flower pot or other object being packaged and which uses a minimum of material, thus minimizing material costs and shipping and storage expenses, and also minimizing the bulkiness of the package to carry, while still providing substantial protection for fragile objects and being easy and inexpensive to assemble and to carry.

While for the preferred embodiment, a handle 24 has been provided which maintains proper alignment of the bands and facilitates carrying of the packaged object, it is possible to perform these functions in other ways. For example, one or two slots or a plurality of holes might be provided in sections 16 and 18 of the bands which slots or holes are aligned when the bands are properly positioned to permit the user to fit his hand or fingers respectively therethrough for carrying. Section 16 might also have a handle die cut therein which could project through a corresponding slot in section 18 to permit carrying of lighter objects.

Thus, while the invention has been described above with reference to a preferred embodiment, the foregoing and other changes in form and detail may be made therein without departing from the spirit and scope of the invention.

What is claimed is:

1. A packaging device for an object having a predetermined shape comprising:

first and second closed bands of flexible material encircling the object in substantially perpendicular vertical planes, each of said bands being of a predetermined size and of sufficient width to keep the object from falling from the package;

said first band lying under said second band in the areas where the bands cross and having an opening formed in the portion thereof overlying the object on either side of the overlying second band; and a handle spanning over the portion of said second band between said openings, said handle having enlarged ends each of which passes through and engages one of said openings in said first band.

2. A device as claimed in claim 1 wherein said first and second bands are substantially identical and interchangeable.

3. A device as claimed in claim 2 wherein each of said bands has a pair of notches formed one in each of the opposite edges of the band at substantially the center of the portion thereof overlying said object;

wherein each of said bands has said openings formed therein; and wherein the notch in the second band overlies the corresponding opening in the first band when the bands are positioned encircling the object;

whereby the ends of the handle pass through both the notch and the opening to maintain the desired relative position between the bands.

4. A device as claimed in claim 1 wherein said object is a fragile object; and wherein said bands are formed of impact resistant material.

5. A device as claimed in claim 4 wherein said bands are formed of corrugated cardboard.

6. A device as claimed in claim 1 wherein said bands are endless and are available in a plurality of sizes; and wherein the bands selected to package an object are the smallest sized bands which will encircle the object.

7. A method of packaging an object having a predetermined shape comprising the steps of:

encircling said object in a first vertical plane with a first closed band of flexible material, said band being of a predetermined size;

encircling said object in a second vertical plane which is substantially perpendicular to said first vertical plane with a second closed band of flexible material, said second band being of a predetermined size and overlying said first band in the areas where the bands cross;

engaging a first enlarged end of a handle having first and second enlarged ends through a first opening formed in the top portion of said first band overlying the top of said object;

spanning said handle over the top portion of said second band; and engaging the second enlarged end of said handle through a second opening formed in said top portion of the first band, the bands being positioned so that said first and second openings are on opposite sides of the top portion of said second band.

8. A method as claimed in claim 7 wherein said first and second bands are substantially identical and interchangeable.

9. A method as claimed in claim 8 wherein each of said bands has a pair of notches formed one in each of the opposite edges of the band at substantially the center of the top portion thereof;

wherein each of said bands has said openings formed therein; and wherein said encircling steps include aligning the top portions of said bands so that the notch in the second band overlies the corresponding opening in the first band; and wherein said engaging steps include passing the end of the handle through both the notch and the corresponding opening to maintain the desired relative position between the bands.

10. A method as claimed in claim 7 wherein said object is a fragile object; and wherein said bands are formed of impact resistant material.

11. A method as claimed in claim 10 wherein said bands are formed of corrugated cardboard.

12. A method as claimed in claim 7 wherein said bands are endless and are available in a plurality of sizes; and including the step of selecting the smallest sized bands which will encircle the object.

* * * * *